US007458312B2

(12) United States Patent
Jacobs et al.

(10) Patent No.: US 7,458,312 B2
(45) Date of Patent: Dec. 2, 2008

(54) AXIAL PISTON MACHINE FOR INDEPENDENT DELIVERY INTO A PLURALITY OF HYDRAULIC CIRCUITS

(75) Inventors: Georg Jacobs, Ulm (DE); Jerzy Kreja, Nersingen (DE)

(73) Assignee: Brueninghaus Hydromatik, GmbH, Elchingen (DE)

( * ) Notice: Subject to any disclaimer, the term of this patent is extended or adjusted under 35 U.S.C. 154(b) by 365 days.

(21) Appl. No.: 10/582,828

(22) PCT Filed: Dec. 13, 2004

(86) PCT No.: PCT/EP2004/014184

§ 371 (c)(1),
(2), (4) Date: Jun. 13, 2006

(87) PCT Pub. No.: WO2005/057009

PCT Pub. Date: Jun. 23, 2005

(65) Prior Publication Data

US 2007/0101858 A1 May 10, 2007

(30) Foreign Application Priority Data

Dec. 15, 2003 (DE) ..... 103 58 728

(51) Int. Cl.
*F04B 1/20* (2006.01)
*F04B 1/22* (2006.01)
*F04B 1/30* (2006.01)

(52) U.S. Cl. ..... 92/71; 60/484; 91/505

(58) Field of Classification Search ..... 60/484; 92/12.2, 57, 71; 91/6.5, 499, 504, 505
See application file for complete search history.

(56) References Cited

U.S. PATENT DOCUMENTS

| | | | | |
|---|---|---|---|---|
| 1,714,148 A | | 5/1929 | Weldy | |
| 2,445,281 A | * | 7/1948 | Rystrom | 91/499 |
| 2,520,632 A | * | 8/1950 | Greenhut | 91/505 |
| 4,223,594 A | * | 9/1980 | Gherner | 91/504 |
| 4,449,444 A | * | 5/1984 | Forster | 91/506 |

FOREIGN PATENT DOCUMENTS

DE 1 653 634 7/1971

(Continued)

OTHER PUBLICATIONS

Abstract of Japanese Patent Publication No. 10184532 A, dated Jul. 14, 1998.

*Primary Examiner*—Igor Kershteyn
(74) *Attorney, Agent, or Firm*—Scully, Scott, Murphy & Presser, P.C.

(57) ABSTRACT

The invention relates to an axial piston machine having a first group of pistons (34.1) for delivering into a first hydraulic circuit and a second group of pistons (34.2) for delivering into a second hydraulic circuit. The pistons (34.1) of the first group and the pistons (34.2) of the second group are supported on a common slanted swash plate (37') and the slanted swash plate (37') can be slanted to a first swivel axis (55) in order to regulate a first delivery volume of the first group of pistons (34.1) in the first hydraulic circuit (55) and to a second swivel axis (56) in order to regulate a second delivery volume of the second group of pistons (34.2) in the second hydraulic circuit.

10 Claims, 5 Drawing Sheets

FOREIGN PATENT DOCUMENTS

| | | | |
|---|---|---|---|
| DE | 1 136 285 | | 6/1979 |
| DE | 30 26 765 | A1 | 2/1982 |
| DE | 34 13 867 C 2 | | 10/1984 |
| EP | 1 367 218 | A1 | 12/2003 |
| FR | 1.340.850 | | 7/1962 |
| GB | 204374 | | 9/1923 |

* cited by examiner

AXIAL PISTON MACHINE FOR INDEPENDENT DELIVERY INTO A PLURALITY OF HYDRAULIC CIRCUITS

BACKGROUND OF THE INVENTION

The invention relates to an axial piston machine having a first group of pistons for delivery into a first hydraulic circuit and having a second group of pistons for delivery into a second hydraulic circuit.

From DE 30 26 765 A1 it is known, in an axial piston machine, to provide a first group of pistons and a second group of pistons, which deliver in each case into a separate hydraulic circuit. In order to be able to adjust a different delivery rate each for the first hydraulic circuit and for the second hydraulic circuit, the pistons of the first group and the pistons of the second group are supported in each case on a separate swash plate. The angles of inclination of the two swash plates are adjustable in each case by means of a separate control device.

The pistons of the first group and the pistons of the second group are disposed along, in each case, a separate graduated circle, wherein the pistons that are associated with the graduated circle having the smaller diameter are supported on a first swash plate, which is of a hemispherical design at the side remote from the pistons and is mounted in the second swash plate. The first and the second swash plate, for independent adjustment of the delivery rates of the first hydraulic circuit and the second hydraulic circuit, are pivotable separately about a common axis, wherein for displacing the first swash plate in the second swash plate a recess is provided, through which the control device accesses the first swash plate. The first swash plate, for varying the dead centre position, may moreover be inclined slightly about a second axis that is perpendicular to the actual swiveling axis.

A drawback of this arrangement is that the second swash plate, whilst it may be mounted in a known manner with a spherical external contour, at the same time has to be designed as a bearing for the first swash plate. A further drawback is that, for adjusting the swivel angle of the inner swash plate, a recess is provided in the second swash plate. As the swash plates have to absorb considerable compressive forces, the required recess may be neither fashioned nor positioned in any desired manner. This leads however to a restriction with regard to the displaceability of the first swash plate, with the result that the volumetric displacement of the corresponding hydraulic circuit is also variable only to a limited extent.

Furthermore, by mounting the two swash plates one inside the other, the overall axial length of the axial piston machine is increased. Some of the advantage of using a single axial piston machine to deliver into two hydraulic circuits is therefore sacrificed.

SUMMARY OF THE INVENTION

The object of the invention is to provide an axial piston machine that is provided for delivery into two hydraulic circuits, the delivery rate of which is individually adjustable, wherein the displaceability is simplified.

The axial piston machine according to the invention comprises a first group of pistons for delivering a pressure medium in a first hydraulic circuit. For adjusting the volumetric displacement for the first hydraulic circuit, the swash plate, on which the pistons of the first group are supported, is pivotable about a first swiveling axis. On the same swash plate, moreover, the pistons of the second group for delivering a pressure medium into a second hydraulic circuit are also supported. In order to adjust the volumetric displacement for the second hydraulic circuit, the swash plate is pivotable about a second swiveling axis, by means of which an effective swept volume of the pistons of the second group is adjusted.

By virtue of the use of two swiveling axes of the swash plate, the swept volume that is effective in each case for the first hydraulic circuit and for the second hydraulic circuit may be individually adjusted. The possible adjustable swivel angles are in said case not limited by the angle adjusted in each case relative to the other swiveling axis. In particular, by virtue of the individual adjustment of the volumetric displacement by means of a single swash plate acting upon the pistons of both groups, it is also possible to dispose the pistons of both groups on a common graduated circle and still enable an individual volumetric displacement adjustment.

Advantageous developments of the axial piston machine according to the invention are represented in the sub-claims.

In particular, it is advantageous for the two swiveling axes to be disposed in such a way that they intersect jointly with the centre line of the axial piston machine at one point. This widens the operative range of the piston machine as a reversal of the delivery direction is easily possible owing to the symmetry. It is moreover particularly advantageous for the two swiveling axes not only to intersect jointly with the centre line of the axial piston machine at one point, but for the swiveling axes also to lie at right angles to one another and to the centre line of the piston machine. This virtue of this angle between the two swiveling axes being as large as possible, a particularly large individual adjustment range is achieved for the two hydraulic circuits.

The pistons of the first and of the second group are disposed in a longitudinally displaceable manner in corresponding first and second cylinder bores respectively. The first and second cylinder bores are connectable in each case by a pair of kidney-shaped control ports to the first and second hydraulic circuit respectively. In each case, a pair of kidney-shaped control ports is then arranged symmetrically relative to the vertical projection of the corresponding swiveling axis into the plane of the kidney-shaped control ports.

A particularly simple bearing arrangement that enables an inclination of the swash plate in any desired direction is moreover achieved by a hemispherical geometry of the swash plate at the side remote from the bearing surface.

It is further advantageous for the pistons of the first and second group that are provided for delivery into the first and second hydraulic circuit respectively to be disposed on a common graduated circle. This leads in particular, given use of the same diameter of the cylinder bores and pistons, to an identical volumetric displacement into the two hydraulic circuits. A further result of disposing all of the pistons on one graduated circle only is an improved synchronism of the axial piston machine, with correspondingly less vibration and reduced noise generation.

For purposefully adjusting different delivery rates in the first and in the second hydraulic circuit, it may also be advantageous for the pistons, whilst being supported on a common swash plate, to be disposed on different graduated circles. In this way it is possible, e.g. for a second delivery circuit, purposefully to limit the maximum delivery rate in a specific ratio to the other hydraulic circuit. The maximum delivery rate is in said case achieved not through the use of only one limited swivel angle range. The result is a correspondingly fine graduating facility for adjustment of the volumetric displacement since the full range of adjustment for the angle of inclination of the swash plate is maintained.

The use of a single swash plate moreover offers the possibility of either using two adjusting devices, which act separately from one another upon the single swash plate, to adjust the inclination of the swash plate in each case relative to a swiveling axis or providing a common adjusting device, which adjusts the swash plate accordingly to its resultant inclination. The use of the common swash plate for both hydraulic circuits moreover provides some freedom with regard to the constructional development of its activation.

An embodiment of an axial piston machine according to the invention is illustrated in a simplified manner in the drawings and described in detail below. The drawings show:

Figure 1:
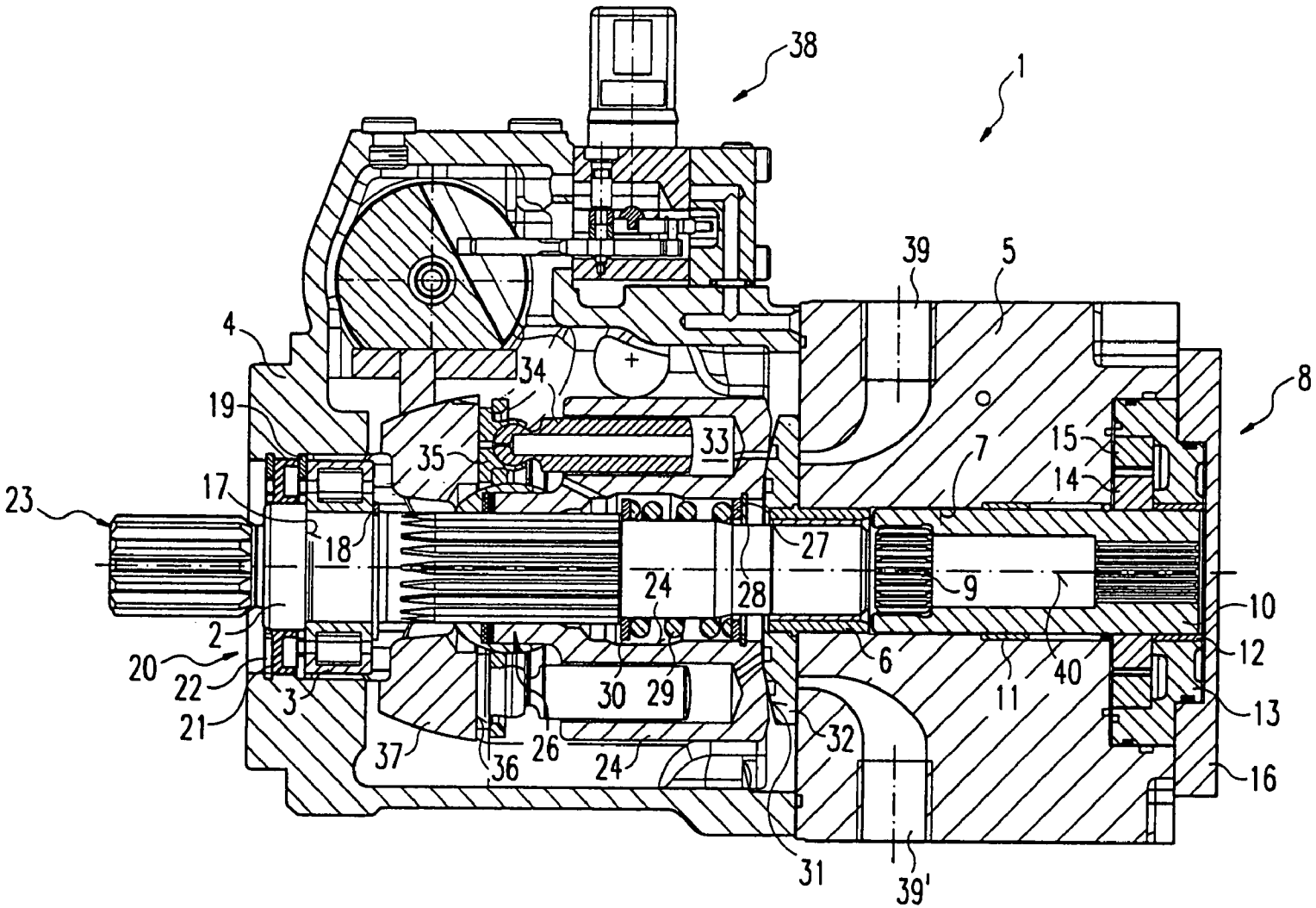
FIG. 1 a sectional view of an axial piston machine for delivery into two hydraulic circuits.

In the longitudinal section of a hydrostatic piston machine 1 according to the invention illustrated in FIG. 1 it is revealed how a common drive shaft 2 is supported by means of a roller bearing 3 at one end of a pump housing 4. The common drive shaft 2 is additionally supported in a plain bearing 6, which is disposed in a connection plate 5 that closes the pump housing 4 at the opposite end.

DETAILED DESCRIPTION OF THE INVENTION

Formed in the connection plate 5 and penetrating the connection plate 5 completely in axial direction is a recess 7, in which on the one hand the plain bearing 6 is disposed and which on the other hand is penetrated by the common drive shaft 2. At the side of the connection plate 5 remote from the pump housing 4, the auxiliary pump 8 is inserted into a radial widening of the recess 7. For driving the auxiliary pump 8, the common drive shaft 2 has gearing 9, which is in mesh with corresponding gearing of an auxiliary pump shaft 10. The auxiliary pump shaft 10 is supported in the recess 7 by means of a first auxiliary pump plain bearing 11 and in an auxiliary pump connection plate 13 by means of a second auxiliary pump plain bearing 12.

Disposed on the auxiliary pump shaft 10 is a gear wheel 14, which is in mesh with an internal gear wheel 15. Via the gear wheel 14 the internal gear wheel 15, which is disposed rotatably in the auxiliary pump connection plate 13, is likewise driven by the auxiliary pump shaft 10 and hence ultimately by the common drive shaft 2. In the auxiliary pump connection plate 13 the suction-side connection and the discharge-end connection for the auxiliary pump 8 are formed. The auxiliary pump 8 is fixed in the radial widening of the recess 7 of the connection plate 5 by means of a cover 16, which is mounted on the connection plate 5.

The inner race of the roller bearing 3 is fixed in axial direction on the common drive shaft 2. The inner race lies at one side against a collar 17 of the common drive shaft 2 and is held in this axial position at the other side by means of a locking ring 18, which is inserted in a groove of the common drive shaft 2. The axial position of the roller bearing 3 in relation to the pump housing 4 is determined by means of a locking ring 19, which is inserted in a circumferential groove of the shaft opening 20. At the other side, the roller bearing 3 lies against a housing shoulder (not shown) of the pump housing 4. Disposed in the shaft opening 20 in the direction of the outside of the pump housing 4 there is moreover a sealing ring 21 and finally a further locking ring 22, wherein the locking ring 22 is inserted into a circumferential groove of the shaft opening 20.

Formed on the end of the common drive shaft 2 that projects from the pump housing 4 is drive gearing 23, via which the hydrostatic piston machine is driven by means of a prime mover (not shown).

Disposed in the interior of the pump housing 4 is a cylinder drum 24, which has a central through-opening 25 that is penetrated by the common drive shaft 2. By means of a driving spline 26 the cylinder drum 24 is connected to the common drive shaft 2 so as to be locked against rotation but displaceable in axial direction, with the result that a rotational movement of the common drive shaft 2 is transmitted to the cylinder drum 24.

Inserted into a circumferential groove formed in the central through-opening 25 is a further locking ring 27, against which a first support disc 28 lies. The first support disc 28 forms a first spring bearing for a compression spring 29. A second spring bearing for the compression spring 29 is formed by a second support disc 30, which is supported against the end face of the driving spline 26. The compression spring 29 therefore exerts, on the one hand, on the common drive shaft 2 and, on the other hand, on the cylinder drum 24 a force in an, in each case opposite, axial direction. The common drive shaft 2 is loaded in such a way that the outer race of the roller bearing is supported against the locking ring 19.

The compression spring 29 acts in the opposite direction upon the cylinder drum 24, which is held with a spherical indentation 31, which is formed on the end face of the cylinder drum 24, in abutment with a control plate 32. The control plate 32 in turn rests with the side remote from the cylinder drum 24 sealingly against the connection plate 5. By means of the spherical indentation 31, which corresponds with a matching spherical outward projection of the control plate 32, the cylinder drum 24 is centered. The control plate 32 may alternatively take the form of a flat disc if, for example, a differently realized centering together with a spherical control plate 32 would lead to an overdetermination.

The position of the control plate 32 in radial direction is fixed by the outer circumference of the plain bearing 6. The plain bearing 6, for this purpose, is inserted only partially into the recess in the connection plate 5.

Cylinder bores 33 are introduced into the cylinder drum 24 so as to be distributed over a common graduated circle and have disposed therein pistons 34, which are longitudinally displaceable in the cylinder bores 33. At the end remote from the spherical indentation 31, the pistons 34 project partially from the cylinder drum 24. At this end, there is fastened to each piston 34 a sliding shoe 35, via which the pistons 34 are supported against a bearing surface 36 of a swash plate 37.

In order to generate a lifting movement of the pistons 34, the angle that the bearing surface 36 of the swash plate 37 forms with a centre line 40 is variable. For this purpose, the inclination of the swash plate 37 may be adjusted by means of an adjusting device 38. For taking up the forces that are transmitted by the sliding shoes 35 to the swash plate 37, the swash plate 37 is supported in the pump housing 4.

For connecting the hydrostatic piston machine 1 to a first hydraulic circuit and to a second hydraulic circuit, a first connection 39 and a second connection 39' are illustrated diagrammatically in the connection plate 5 and connectable in a non-illustrated manner by the control plate 32 to the cylinder bores 33.

Figure 2:
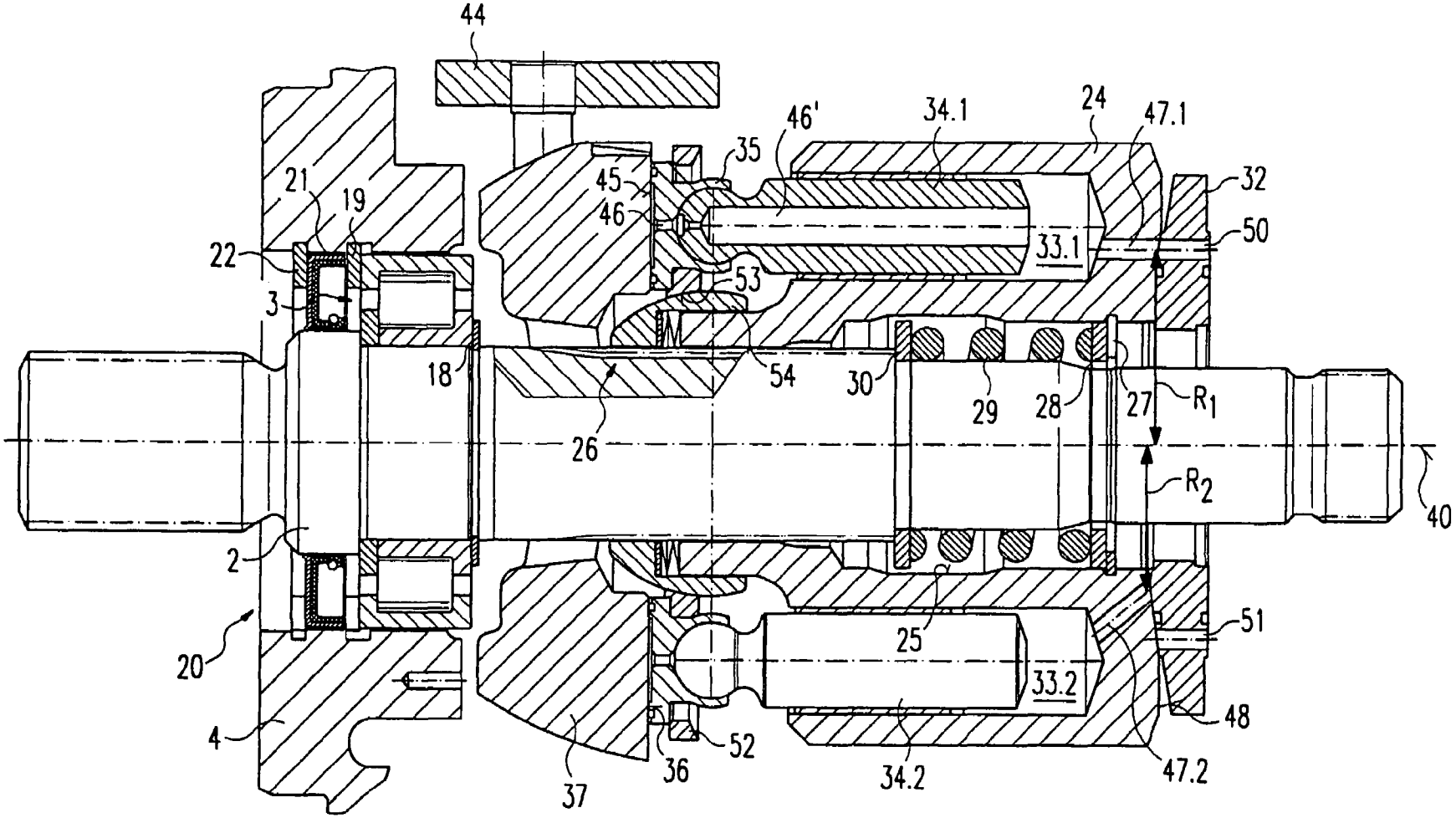
FIG. 2 an enlarged view of the drive mechanism of the axial piston machine according to FIG. 1.

An enlarged view of the components that interact in the interior of the pump housing 4 is shown in FIG. 2.

For executing a swiveling movement, the swash plate 37 is coupled to a slide block 44, which in a non-illustrated manner rotates the swash plate 37 about an axis lying in the drawing plane.

The cylinder bores generally denoted by 33 in FIG. 1 are divided into a first group of cylinder bores 33.1 and a second group of cylinder bores 33.2. As has already been briefly explained in the description pertaining to FIG. 1, against the end of each piston 34 remote from the control plate 32 a sliding shoe 35 is disposed. The sliding shoe 35 is fastened by a recess to a spherical head of the piston 34, so that the sliding shoe 35 is fastened movably to the piston 34 and tensile and compressive forces are transmissible.

Formed on the sliding shoe 35 is a sliding surface 45, by which the sliding shoe 35 and hence the piston 34 are supported on the bearing surface 36 of the swash plate 37. Formed in the sliding surface 45 are lubricating oil grooves, which are connected by a lubricating oil channel 46, which is formed in the sliding shoe 35 and continued in the piston 34 as lubricating oil bore 46', to the cylinder bores 33 formed in the cylinder drum 24.

Because the sliding shoes 35 are supported against the bearing surface 36, the pistons 34 upon rotation of the common drive shaft 2 execute a lifting movement, by means of which the pressure medium situated in the cylinder chambers in the cylinder drum 24 is placed under pressure. The sliding shoes 35 are hydrostatically relieved at the bearing surface 36 of the swash plate 37. In order to deliver the pressure medium from the cylinder chambers into the first and second hydraulic circuit, first connecting channels 47.1 and second connecting channels 47.2 are connected to the cylinder bores of the first group 33.1 and the cylinder bores of the second group 33.2 respectively. The first and second connecting channels 47.1 and 47.2 extend from the cylinder bores of the first group 33.1 and the cylinder bores of the second group 33.3 respectively to the spherical indentation 31 formed in an end face 48 of the cylinder drum 24.

In the control plate 32, which is connected to the connection plate 5 so as to be locked against rotation, a first kidney-shaped control port 50 and a second kidney-shaped control port 51 are formed, which penetrate the control plate 32 in axial direction.

Preferably a third kidney-shaped control port and a fourth kidney-shaped control port are further formed in the control plate 32, these ports not being visible in FIG. 2 because of the position of the cutting plane. While the first and the second kidney-shaped control port 50 and 51 are connected by the connection plate 5 to the working lines of the first hydraulic circuit, the third and the fourth kidney-shaped control port are connected in a corresponding manner to the working lines of the second hydraulic circuit. The geometric design of the kidney-shaped control ports in the control plate 32 is additionally described below with reference to FIG. 5.

The first and second kidney-shaped control ports 50 and 51 are at an identical first distance $R_1$ from the centre line 40 of the cylinder drum 24 that is greater than the distance $R_2$, which in turn is identical for the third and fourth kidney-shaped control ports. During a revolution of the common drive shaft 2 the first connecting channels 47.1 are connected alternately to the first kidney-shaped control port 50 and the second kidney-shaped control port 51, so that because of the lifting movement of the pistons 34 disposed in the cylinder bores 33.1 of the first group the pressure medium is taken in e.g. through the second kidney-shaped control port 51 and pumped through the first kidney-shaped control port 50 into the discharge-end working line of the first hydraulic circuit.

In the illustrated embodiment, the first connecting channels 47.1 are disposed in such a way in the cylinder drum 24 that the first distance $R_1$ of the mouth at the end face 48 is greater than the second distance $R_2$, at which the second connecting channels 47.2 open out at the end face 48. The second connecting channels 47.2 have a radial direction component and accordingly open out at the end face 48 of the cylinder drum 24 at the second distance $R_2$, which corresponds with the distance of the third and fourth kidney-shaped control port from the centre line 40. Thus, during a revolution of the common drive shaft 2 the cylinder bores of the second group 33.2 are connected by the second connecting channels 47.2 alternately to the third and fourth kidney-shaped control port.

In order during an intake stroke to prevent the sliding shoes 35 from lifting off the bearing surface 36 of the swash plate 37, a retraction plate 52 is provided, which encompasses the sliding shoes 35 at a shoulder provided for this purpose. The retraction plate 52 has e.g. a spherical, central recess 53, with which it is supported against a retraction ball 54 that is disposed on the end of the cylinder drum 24 remote from the end face 48.

Figure 3:
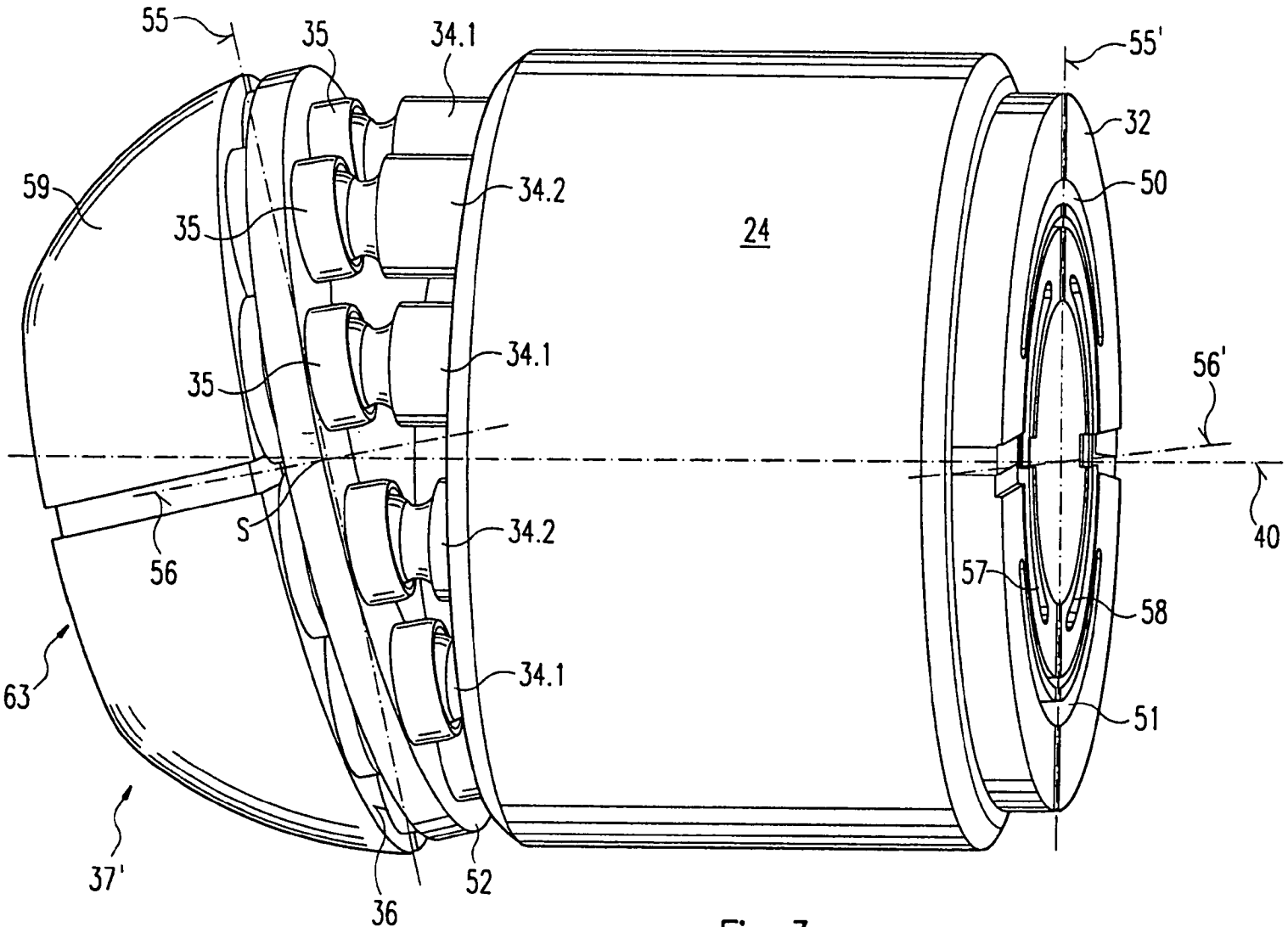
FIG. 3 a diagrammatic view with a swash plate inclined about a swiveling axis.

In FIG. 3 it is revealed how, proceeding from an axial piston machine of FIGS. 1 and 2, with a swash plate 37' an independent adjustment of the delivery rates for the two hydraulic circuits may be achieved.

The swash plate 37' is inclinable about a first swiveling axis 55 and about a second swiveling axis 56. The first and the second swiveling axis 55 and 56 lie in the plane of the bearing surface 36 of the swash plate 37 and, when the axial piston machine is set to zero volumetric displacement in both hydraulic circuits, form an angle of 90° with the centre line 40.

In FIG. 3 the swash plate 37' is shown inclined about the second swiveling axis 56. This produces an effective stroke for delivering pressure medium into the second hydraulic circuit. What is meant by an effective stroke, here, is a movement of the pistons 34 that leads to an actual delivery of pressure medium. In order therefore to enable the adjustment of two delivery rates for the first hydraulic circuit and the second hydraulic circuit independently of one another, the third kidney-shaped control port 57 and the fourth kidney-shaped control port 58 are disposed in each case symmetrically relative to a vertical projection 56' of the second swiveling axis 56 into the plane of the kidney-shaped control ports.

Thus, the second connecting channels 47.2 move during a half revolution of the cylinder drum 24 from the bottom dead centre to the top dead centre substantially along the third kidney-shaped control port 57, so that the pressure medium is pressed through the third kidney-shaped control port 57 into the discharge-end working line of the second hydraulic circuit. During the second half of a revolution of the cylinder drum 24, the second connecting channels 47.2 accordingly move en route from the top dead centre to the bottom dead centre substantially along the fourth kidney-shaped control port 58 and execute an intake stroke.

As may already be seen in FIG. 3, the first kidney-shaped control port 50 and the second kidney-shaped control port 51 are in turn formed symmetrically relative to a vertical projection 55' of the first swiveling axis 55 into the plane of the kidney-shaped control ports. In the illustrated, preferred form of construction, the first swiveling axis 55 and the second swiveling axis 56 are disposed at right angles to one another. The first and second kidney-shaped control ports 50 and 51 as well as the third and fourth kidney-shaped control ports 57 and 58 in the control plate 32 are accordingly disposed likewise rotated through 90° relative to one another.

A delivery into the first hydraulic circuit does not occur, given the illustrated deflection of the swash plate 37'. The position of the first and second kidney-shaped control port 50 and 51 is symmetrical relative to the position of the top and bottom dead centre respectively, so that despite the use of the common swash plate 37' in the first hydraulic circuit only a slight pulsation is produced, so long as the swash plate 37' is not additionally inclined about the first swiveling axis 55. The arrangement of the first to fourth kidney-shaped control ports 50, 51, 57 and 58 in the control plate 32 is explained once more in the description pertaining to FIG. 5.

In the illustrated preferred form of construction, the first swiveling axis 55 and the second swiveling axis 56 are disposed at right angles to one another, wherein both swiveling axes 55 and 56 lie in the plane of the bearing surface 36. The point of intersection of the first swiveling axis 55 with the second swiveling axis 56 coincides with the point of intersection of both swiveling axes 55 and 56 with the centre line 40.

At its side remote from the bearing surface 36, the swash plate 37' at least in a region 59 adjoining the bearing surface 36 is of a hemispherical design. As a bearing, a ball bearing or a plain bearing may be provided for supporting the swash plate and enabling rotation thereof.

In order to keep the axial overall length of the axial piston machine as low as possible, the hemispherical region 59 is delimited by a flattened area 63 formed preferably parallel to the bearing surface 36.

The adjustment of the inclination of the swash plate 37' may be effected either by means of a separate adjusting device for each swiveling axis 55 and 56, wherein in FIG. 1 only the adjusting device for the swiveling axis 55 is shown and the adjusting device for the swiveling axis 56 is not visible in the sectional view, or by means of a common adjusting device, by means of which a resultant angle of inclination of the swash plate 37' is adjusted.

Figure 4:
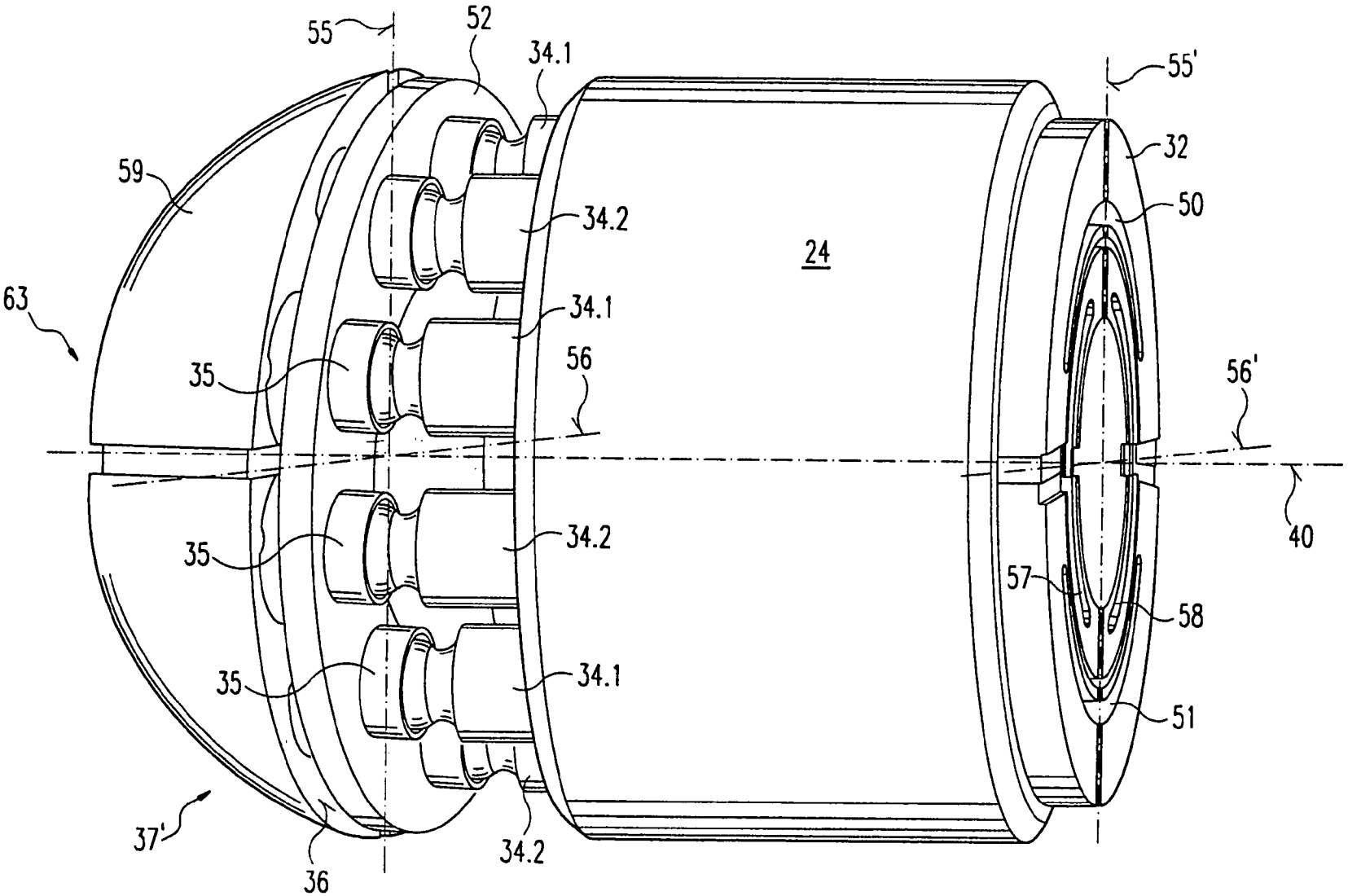
FIG. 4 a diagrammatic view with a swash plate inclined about another swiveling axis.

FIG. 4 shows the swash plate 37' situated in its neutral position with regard to the second swiveling axis 56, but inclined with regard to its first swiveling axis 55. Thus, an effective stroke is produced only for the pistons 34 that are connected by the first connecting channels 47.1 during a revolution of the cylinder drum 24 alternately to the first kidney-shaped control port 50 and the second kidney-shaped control port 51.

The pistons that are connectable by the second connecting channels 47.2 to the third kidney-shaped control port 57 and the fourth kidney-shaped control port 58, on the other hand, in the region, where a connection to the respective hydraulic circuit is established, execute merely a slight movement about the bottom dead centre and the top dead centre respectively that in turn produces only a slight pulsation in the working lines of the second hydraulic circuit.

Figure 5:
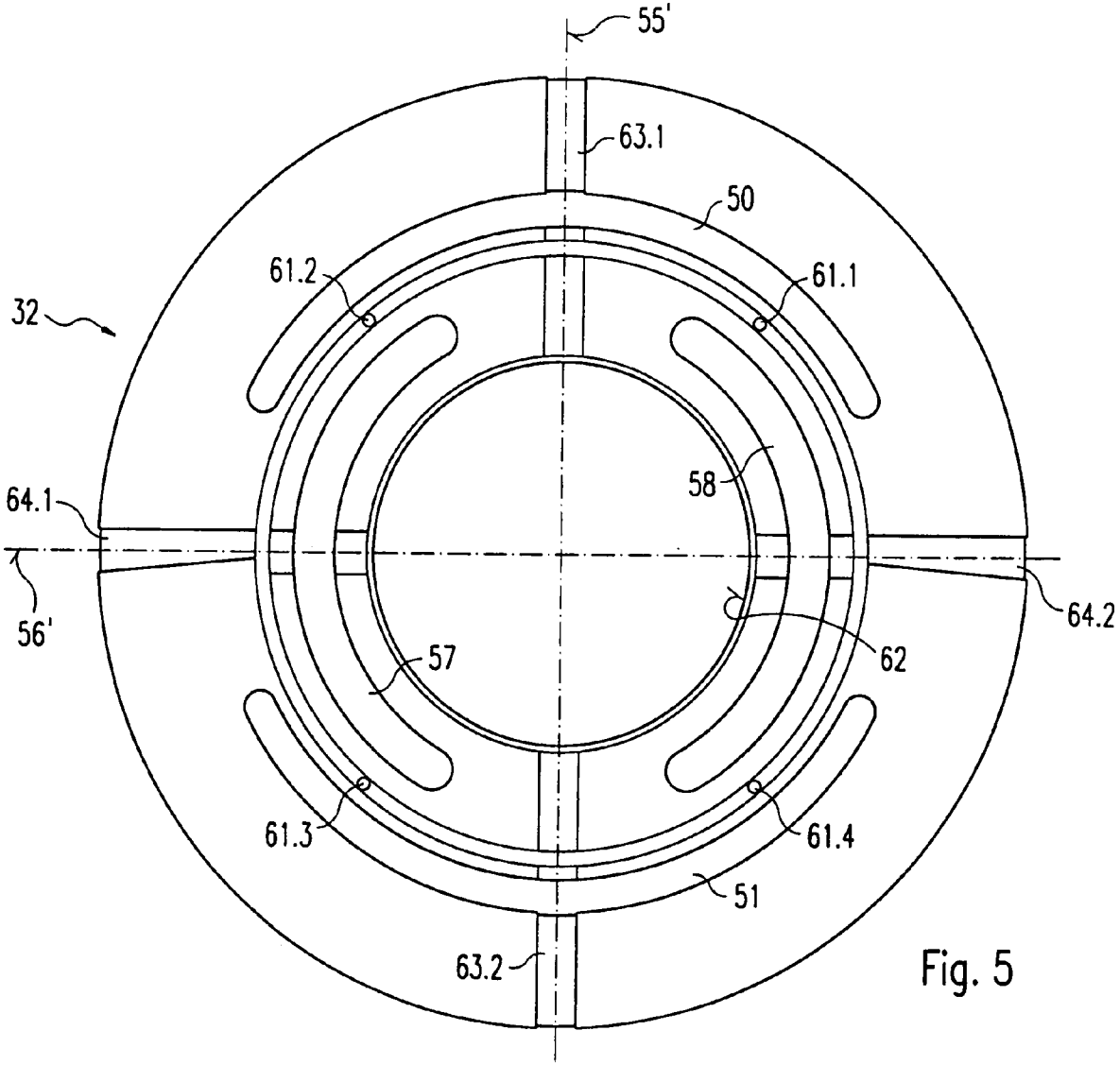
FIG. 5 a plan view of a control plate of the axial piston machine according to the invention.

FIG. 5 shows the control plate 32 in plan view. In the preferred embodiment, the first swiveling axis 55 and the second swiveling axis 56 are perpendicular to one another. The vertical projections 55' and 56' illustrated in FIG. 5 in said case form in each case an axis of symmetry for the first and the second kidney-shaped control port 50 and 51 and for the third and the fourth kidney-shaped control port 57 and 58.

The control plate 32 has in the centre a centering opening 62, by which the position of the control plate in the axial piston machine 1 is defined. The centering opening 62 for this purpose centers the control plate on the plain bearing 6. Along the projection 55' of the first swiveling axis 55 there extends in radial direction from the centering opening 61 in each case a groove 63.1 and 63.2. In each case, a further groove 64.1 and 64.2 extends in an analogous manner along the projection 56' of the further swiveling axis 56. The four grooves 63.1, 63.2, 64.1 and 64.2 are connected to one another by an annular groove 60.

The annular groove 60 itself is disposed concentrically with the centering opening 62 and the kidney-shaped control ports. The kidney-shaped control ports 50 and 51 extend in said case along a circular line having a radius that is greater than the radius of the circular line, along which the third and fourth kidney-shaped control port 57 and 58 extend. In the annular groove 60 extending therebetween, four bores 61.1 to 61.4 are arranged in a uniformly distributed manner. The bores 61.1 to 61.4 connect the annular groove 60 to the side of the control plate 32 facing the cylinder drum 24. Thus, leakage pressure medium may be carried off into the interior of the axial piston machine 1.

The generation of an effective stroke for delivering pressure medium into a first and into a second hydraulic circuit through swiveling of the swash plate 37' is not restricted to axial piston machines, in which the pistons 34.1 of the first group and the pistons 34.2 of the second group are disposed on a single, common graduated circle. The two groups of pistons and cylinder bores may equally well be disposed in one cylinder drum, but on two different graduated circles.

Besides the axial piston machine for two separate, closed circuits that is illustrated in the drawings, an axial piston machine for two open circuits or for one closed and one open circuit may also be provided with the adjustment of the volumetric displacement according to the invention. Also, more than two circuits are easily conceivable.

The invention claimed is:

1. Axial piston machine having a first group of pistons for delivery into a first hydraulic circuit and at least a second group of pistons for delivery into at least a second hydraulic circuit, wherein the pistons of the first group and the pistons of the second group are supported on a common swash plate, and that the swash plate for adjusting a first volumetric displacement of the first group of pistons into the first hydraulic circuit is pivotable about a first swiveling axis and for adjusting a second volumetric displacement of the second group of pistons into the second hydraulic circuit is pivotable about a second swivelling axis.

2. Axial piston machine according to claim 1, wherein the first swivelling axis and the second swivelling axis and a centre line of the axial piston machine intersect at a point (S).

3. Axial piston machine according to claim 1, wherein the first swivelling axis and the second swivelling axis are approximately perpendicular to one another.

4. Axial piston machine according to claim 1, wherein pistons of the first group are disposed in a longitudinally displaceable manner in first cylinder bores, wherein the first cylinder bores are connectable to the first hydraulic circuit by a first kidney-shaped control port and by a second kidney-shaped control port and the first kidney-shaped control port and the second kidney-shaped control port are disposed in each case opposite in relation to a vertical projection of the first swivelling axis into the plane of the first and second kidney-shaped control port.

5. Axial piston machine according to claim 1, wherein the pistons of the second group are disposed in a longitudinally displaceable manner in second cylinder bores, wherein the second cylinder bores, are connectable to the second hydraulic circuit by a third kidney-shaped control port and by a fourth kidney-shaped control port and the third kidney-shaped control port and the fourth kidney-shaped control port are disposed opposite in relation to a vertical projection of the second swivelling axis into the plane of the third and fourth kidney-shaped control port.

6. Axial piston machine according to claim 1, wherein the swash plate at its side remote from the pistons has a region with a hemispherical geometry.

7. Axial piston machine according to claim 1, wherein the pistons of the first group and the pistons of the second group are disposed in a longitudinally displaceable manner in cylinder bores, which are disposed on a common graduated circle in a cylinder drum.

8. Axial piston machine according to claim 1, wherein the pistons of the first group and the pistons of the second group are disposed in a longitudinally displaceable manner in first cylinder bores and second cylinder bores respectively, wherein the first cylinder bores and the second cylinder bores are disposed on different graduated circles in a cylinder drum.

9. Axial piston machine according to claim 1, wherein for adjusting the inclination of the swash plate relative to the first swiveling axis and for adjusting the inclination of the swash plate relative to the second swiveling axis in each case an adjusting device is provided.

10. Axial piston machine according to claim 1, wherein for adjusting the inclination of the swash plate relative to the first swiveling axis and relative to the second swiveling axis a common adjusting device is provided.

* * * * *